US006553614B1

(12) United States Patent
Leon

(10) Patent No.: US 6,553,614 B1
(45) Date of Patent: Apr. 29, 2003

(54) VACUUM CLEANER WITH AIR/WATER SEPARATOR HUB

(76) Inventor: Marty Gerard Leon, 18416 N. 31st Ave., Phoenix, AZ (US) 85023-1124

( * ) Notice: Subject to any disclaimer, the term of this patent is extended or adjusted under 35 U.S.C. 154(b) by 775 days.

(21) Appl. No.: 08/815,441

(22) Filed: Mar. 11, 1997

(51) Int. Cl.[7] ..... A47L 9/18
(52) U.S. Cl. ..... 15/353
(58) Field of Search ..... 15/321, 353

(56) References Cited

U.S. PATENT DOCUMENTS 4,218,805 A * 8/1980 Brazier ..... 15/321
5,184,370 A * 2/1993 Jung ..... 15/321
5,254,147 A * 10/1993 Finke ..... 15/353 X
5,353,469 A * 10/1994 Fellhauer ..... 15/353 X

* cited by examiner

*Primary Examiner*—Chris K. Moore
(74) *Attorney, Agent, or Firm*—John P. Halvonik

(57) ABSTRACT

An air and water hub for the separation of excess water from air is constructed at the top of a canister assembly that is used for the induction of air, dust and water. The hub is a spinning member rotating within the canister assembly near the top thereof, and is powered by a shaft connecting the hub to the vacuum motor at the top of the assembly. The hub spins within the circumference of the top of the canister, and the rotating action removes the water from air by forcing it against the inside walls of the assembly. A gap between the inner wall and the hub allows the water to drain downward along the inside of the assembly. The hub may be used with ah hourglass-shaped induction assembly that directs the flow of air, water and dust to the hub from below.

4 Claims, 4 Drawing Sheets

VACUUM CLEANER WITH AIR/WATER SEPARATOR HUB

FIELD OF THE INVENTION

The invention relates to the field of vacuum cleaners and in particular an improved vacuum cleaner having an air/water separator hub that operates as an interface between a vacuum motor and an induction chamber. The invention is believed to find most use in the field of wet and dry vacuums where the vacuum motor is designed to create a suction effect within a canister or similar housing water that is taken in along with dirt and dust is separated from the water at the bottom of the assembly. The hub is located at the top of the assembly and serves to further remove water by cyclonic action at the top of the assembly.

PRIOR ART

While there are wet/dry vacuums that are used in the prior art none of them that the applicant is aware of have a spinning hub at the top of the induction assembly in order to remove the last traces of water from the air stream prior to reaching the motor.

SUMMARY OF THE INVENTION

An air and water hub for the separation of excess water is shown and described The hub is constructed at the top of a canister assembly that is used for the induction of air, dust, etc. in the vacuum assembly. The hub may be thought of as a spinning member that rotates within the canister assembly and near the top. The hub may be powered by a shaft that connects the hub to the vacuum motor at the top of the assembly. The hub spins within the circumference of the top of the canister and the rotating action should remove the water by forcing the water against the inside walls of the assembly. A gap between the inner wall and the hub provides for the water to drain downward down the inside of the assembly.

There may be constructed an outer groove running in connection with the hub and on the outside of the induction assembly. The groove is used to hold a sponge or similar type of material that can hold water in order to remove excess water from the top of the inducted air stream as that air stream reaches the top of the canister.

It is among the object of the invention to provide an improved induction canister assembly for wet dry vacuums that has a spinning hub at the top of the assembly for further removal of water from the inducted air stream.

Another objective is to protect the motor located in connection with an induction assembly from coming into contact with excess water.

Another objective is to further the separation of dirt and water from air in a wet/dry vacuum by the action of a spinning hub in connection with an hour glass shaped induction assembly that serves to compress the water and dirt mixture by the centrifugal action of the hub.

Another objective is to enhance the removal of fine grains of dust that may escape from the bag of the vacuum by ejecting dirt through the perforated area of the assembly that is described below.

Other objectives will be apparent to those skilled in the art.

DESCRIPTION OF THE PREFERRED EMBODIMENT

Figure 1:
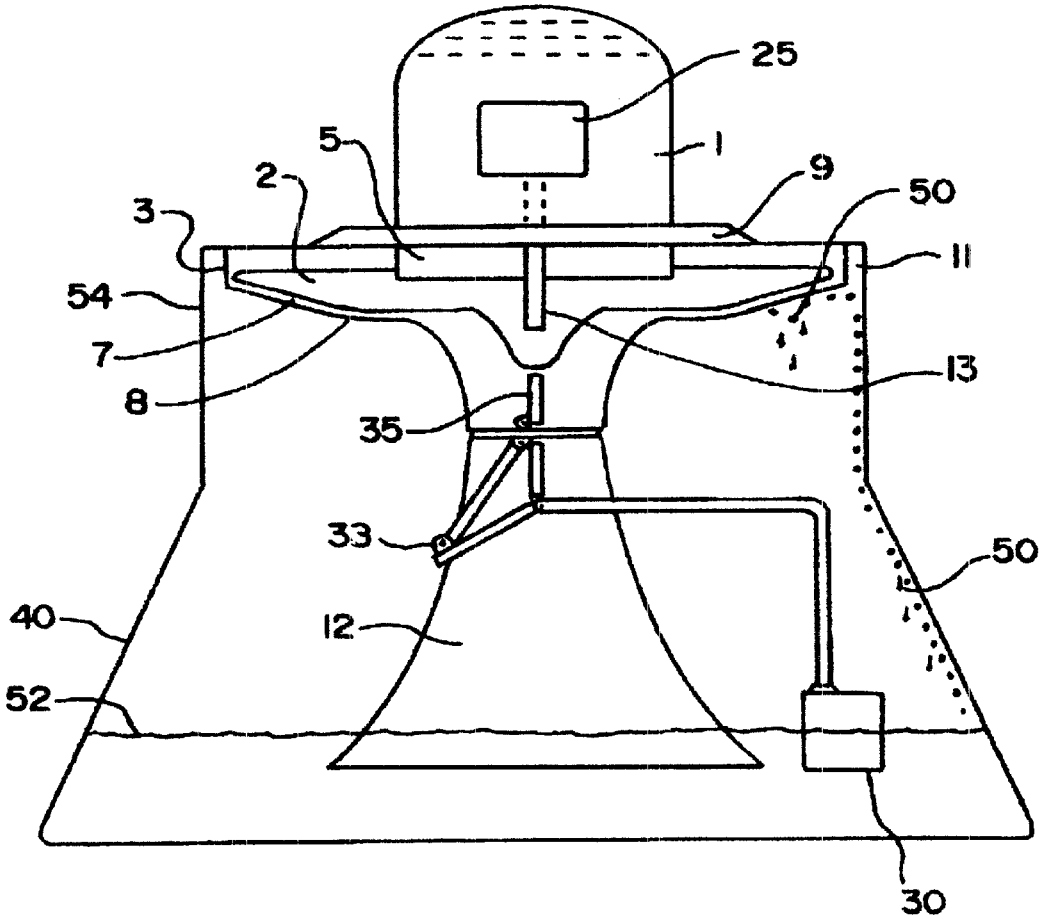
FIG. 1 Cross section of the assembly.
Figure 3:
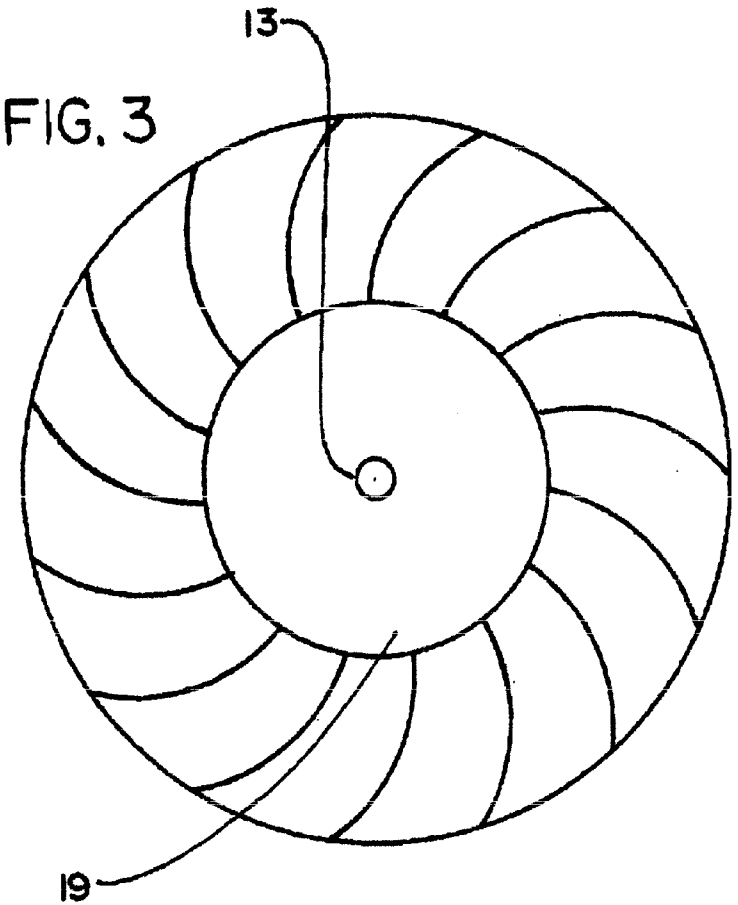
FIG. 3 top view of hub.

The motor area 1 is shown at the top of the induction chamber in FIG. 1. The spinning 2 hub is shown in connection with the motor and underneath the motor as one views the cross section. A typical venturi shaped assembly that may be used in the invention is shown as 12 in FIGS. 1, 3 and 4. The invention may find uses in other types of induction chambers that may be of different shape than that shown here. That structure 54 shown as an enclosure around the venturi is a support chamber similar to that shown in U.S. Pat. No. 5,498,272. 40 depicts the main chamber that houses part of the venturi assembly. The main chamber is similar to that shown in U.S. Pat. No. 5,498,272.

Figure 4:
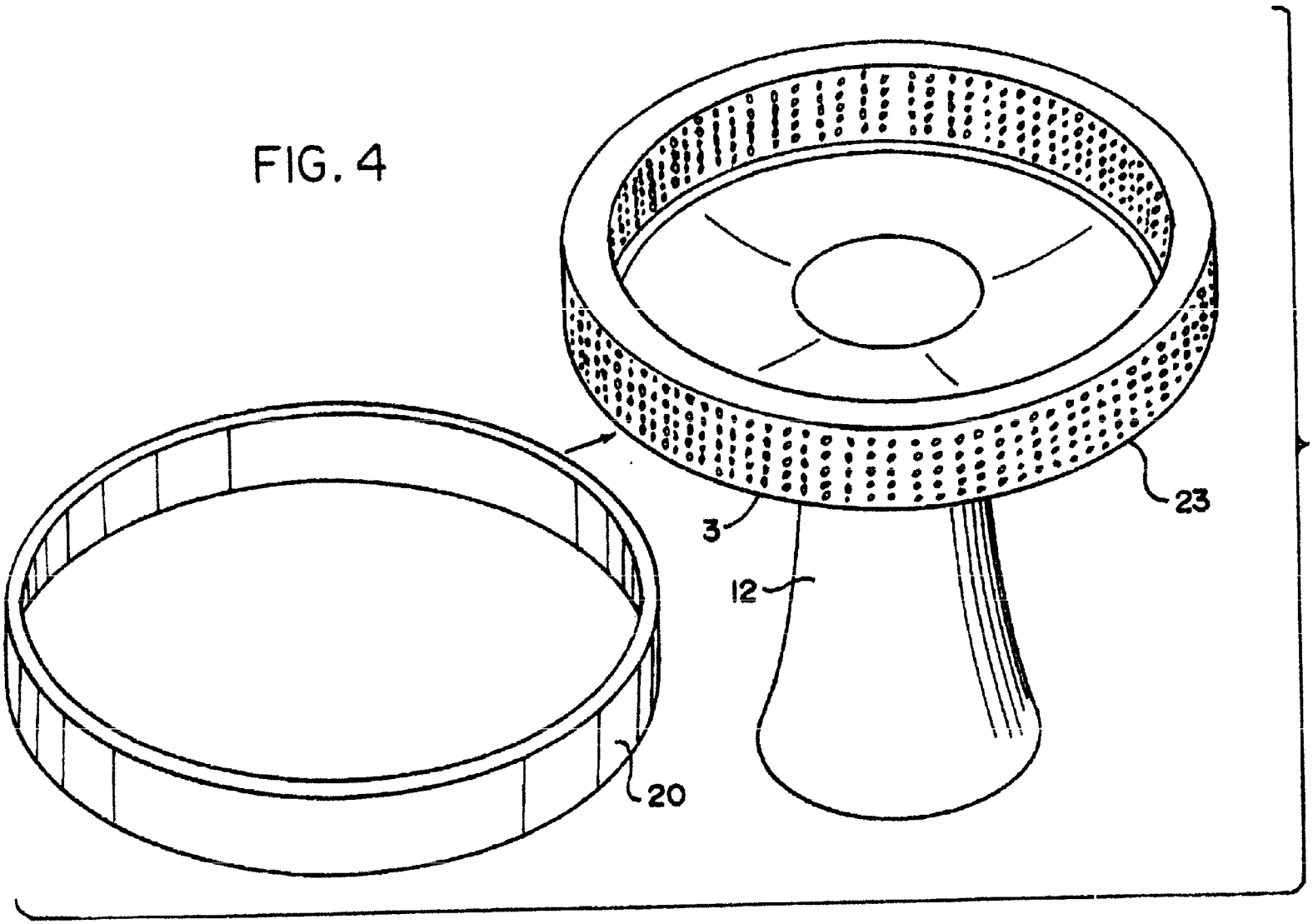
FIG. 4 foam band and venturi assembly.

The shaft 13 that connects the spinning hub 2 to the motor (motor not shown, it is inside the motor chamber 1) is shown in FIG. 1. The shaft should be connected by any state of the art means that allows the motor to rotate the shaft. The shaft is in turn connected to the hub and imparts this rotation onto the hub. The hub is made of slightly smaller diameter than the diameter of the induction assembly 12 (shown in more detail in FIG. 4) so as to create a gap 7 between the hub and that surface 8 of the upper, perforated section 3 of the induction assembly as shown. This upper section of the induction assembly 12 will flare outward as shown in FIGS. 1 and 4. Surface 8 is created by this curved outward nature, it is not seen in FIG. 4 but is shown in FIG. 1.

Figure 5:
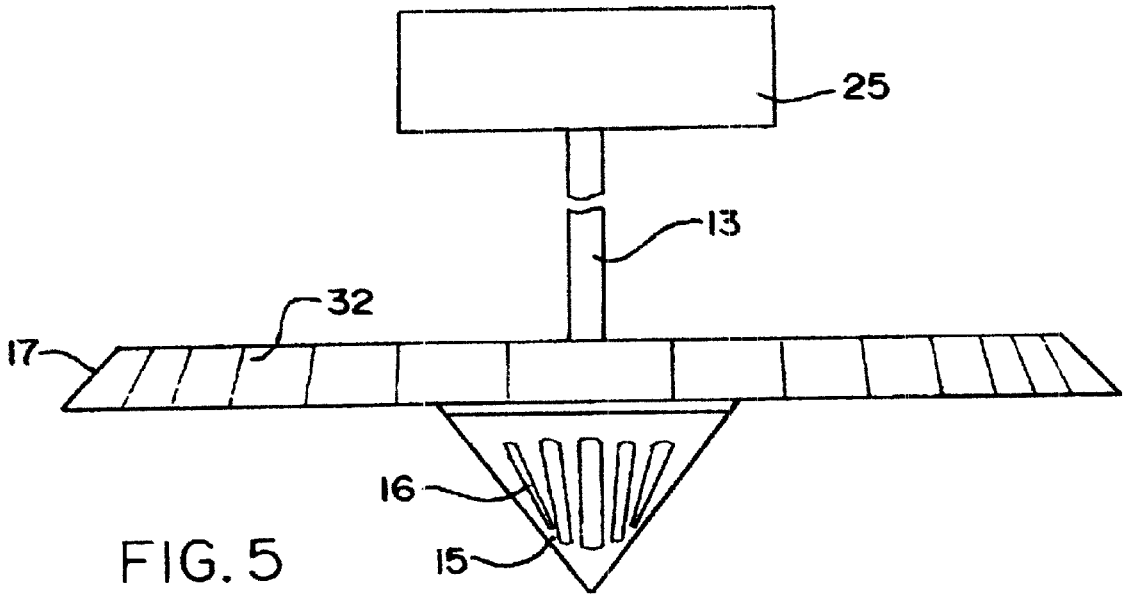
FIG. 5 side view of hub compressor.

Because water is heavier than air, excess water (droplets shown as 50) will be flung outward and against the surface 8 of this chamber by centrifugal force. However, the exact manner that this process happens may vary and the inventor does not wish to be bound by any theories of this action. The upper rim 3 of the venturi induction chamber or a similar induction chamber should have a series of perforations 23 lateral to the position of the spinning hub edge 42, see FIG. 5. The perforations should cover an area of roughly the upper half of the hour glass or venturi chamber 12. The exact placement and size of the perforations may vary depending on the actual operating parameters. A pair of plates 17 may be used in connection with the spinning hub in order to enhance compression and increase the vacuum formed. In FIG. 5 the air will go the center of plates. In embodiment shown in FIG. 6 the air flow (see arrows) will go around the edges of the plate 17 and the the blades.

There is a gap 11 between the side of the rim 3 and the inside wall of the support chamber 54. Into this gap there is placed another band made of foamed or sponge material 20 (in FIG. 4) that may be placed inside this gap, see FIG. 4. The water droplets 50 will thereby descend downward down the walls of the induction assembly as seen in FIG. 1. The water level (when used in the wet mode) in the canister is shown as 52.

During the vacuuming process, some water will be inducted upward in the air stream within the assembly and, upon reaching the hub, will be flung outward. Much of the water will exit through the apertures 23 and thereby descend downward down the walls of the induction assembly. Some of the water may also fall downward down the inside of the assembly.

The gap 7 is shown in detail in FIG. 1 and the shape of the hub 2 is shown to parallel the shape of the induction chamber at this point in the assembly. That is the shape of the induction assembly may be described as an hourglass shape. The top 3 of the assembly therefore is the top of the hourglass and this portion has a shape that flares outward. The shape of the blades of the hub 2 is seen to parallel this shape. The gap between hub and wall 8 will also help to govern the flow of air coming through the induction assembly more thoroughly. The air will be spread by the shape of the hourglass chamber and the gap and will thus be spread through a broader area at the top of the induction assembly.

As the spinning hub is used during the vacuuming operation, the action of spinning hub will further the goal of separating the dirt from the air and water by the centrifugal force generated by the hub as it compresses air within the a forementioned gap.

Figure 2:
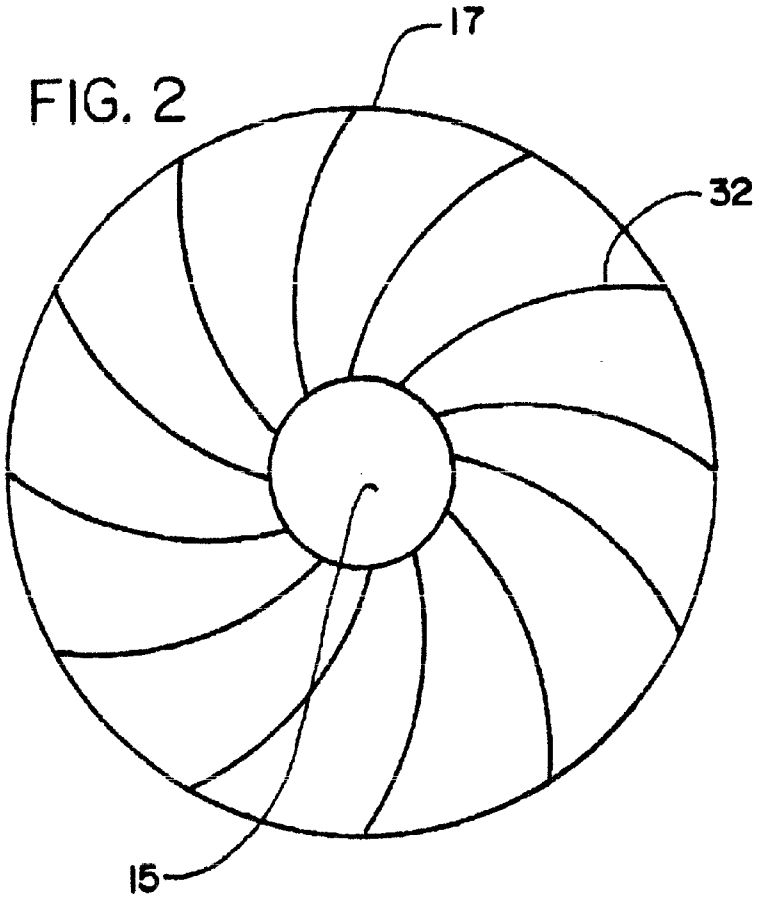
FIG. 2 bottom view of hub.
Figure 6:
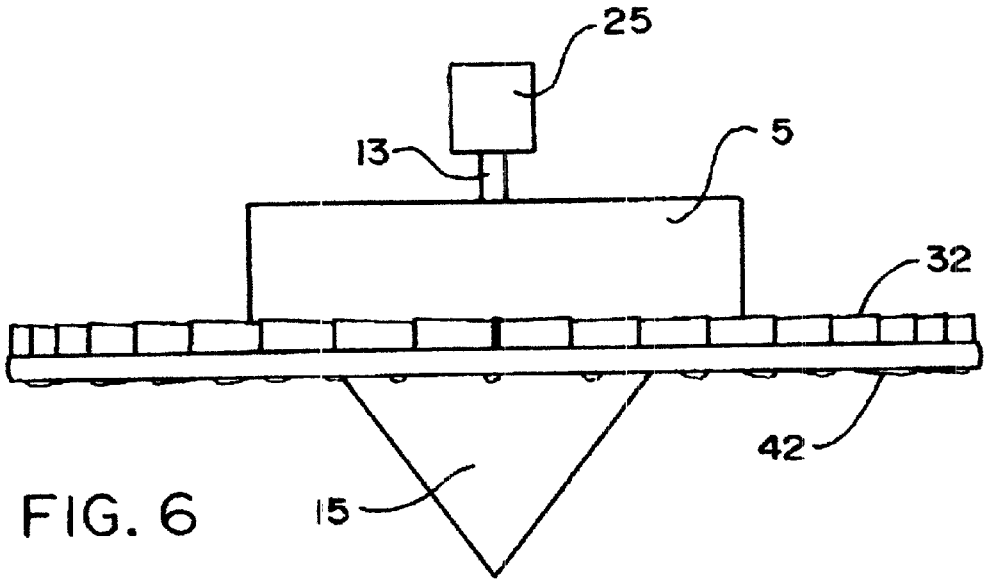
FIG. 6 Side view of hub deflector assembly.

A series of vanes 32 may be added to the spinning hub, see FIGS. 2 and 6. The actual number and size of the vanes may vary. These should be oriented in the downward direction as one views the hub so that the vanes will come in close contact with the inner walls of the induction chamber. Using these vanes, the hub can in effect accelerate or force the water and/or dirt through perforations 23 on the inside of the wall and thereby force it outward and through the walls of the assembly.

The water and/or dirt will then drain downward and into the bottom of the canister that houses the assembly. The same effect may be achieved by adding blades to the top of the hub (FIGS. 3 and 6) so as to keep water away from the air filter and moving the water outward towards the perforations of the chambers. The leading or peripheral edges of the hubs may be rounded for smoother air transition. The blade edges 42 may also be angled as seen in FIG. 5 so that the edge of the impeller will allow the swift moving air to shift upward more quickly while accelerating debris particles laterally to the sides of the chamber. The bottom edges of the vanes 32 may also be rounded.

Through further development and with the use of the hourglass chamber for bag usage, a perforated magnetic band may be placed atop the chamber to attract the finer dust particles and aid in the air/dirt separation process.

A foam filter 5 may be used in connection with the hub and is shown between the hub and the motor 25 in FIGS. 1 and 6. A space 9 may be created between the motor area 1 and the hub 2 to accommodate the filter. This filter may be made of any suitable water absorbing material so as to collect excess water and prevent it from coming in connection with motor. The filter would preferably be of smaller diameter than the hour glass chamber so that it can rest between the hub and the motor.

Parts 30, 33 and 35 illustrate a floatation system that is designed to cut off the flow of air in the event that he level of water in the canister rises to a level that is dangerous. 30 is a float in connection with the inside of the canister. 33 is pivoting means that connects the float with the cutoff valve 35 that will close in the event that the float rises to a position that is dangerous. 56 is a capstan that supports the venturi and is preferably used with the invention. Both the capstan and system are shown and described in applicant's previous U.S. patent referred to above. Other cut off systems may be used without varying from the spirit of the invention.

As another option, a modified impeller (FIG. 5) may be used as a separate vacuuming stage. That is, the action of the hub may be so chosen so that it creates another vacuum in addition to that created by the motor at the top of the assembly. A series of stages may be created in such an assembly by using the vacuum motor as well as one or more spinning hubs to create further vacuum stages. The stages preferably would be located one above the other. A conical shaped spinner 15 may be used in connection with the spinning hub as shown in FIG. 5. This spinner will be facing downward and into the opening in the induction chamber. There may be a series of slots 16 in the spinner in order to deflect the slower moving water and dirt toward the outside edges of the hub while allowing the quicker moving air to go straight through and into the blades of the hub or impeller.

I claim:

1. An improved vacuuming assembly for wet and dry vacuums and for use inside of a vacuum canister, the assembly comprising the following: a motor chamber in connection with an induction chamber, said induction chamber having an hourglass shape having a middle section, an upper section and a lower section so as to produce a venturi effect, said upper section and said lower section of larger diameter than said middle section, said induction chamber having an upper opening and a lower opening in connection with one another so as to create a channel throughout said induction chamber, a series of apertures in said upper section, an impeller assembly fixed for rotation at a point above said induction chamber and having blades of size and shape parallel to the shape of said upper section so as to create a gap between said upper section and said spinning blades, a motor in connection with said motor chamber and in connection with a drive shaft, said drive shaft in connection with said impeller assembly so that said impeller assembly may induct air upward through said induction chamber and with sufficient speed to force air and water particles through said apertures.

2. The apparatus of claim 1 having a support structure of size and shape to house said assembly so as to leave a gap between said support structure and said upper section, and having a band of foamed material having absorbent properties in connection with said gap so as to surround said upper section.

3. The apparatus of claim 2 having an absorbing member located between said impeller assembly and said motor chamber.

4. The apparatus of claim 3 wherein said blades have a series of vanes that extend downward from said blade and are of sufficient size so as to sweep water from said upper section.

* * * * *